US008596175B2

(12) United States Patent
Weber

(10) Patent No.: US 8,596,175 B2
(45) Date of Patent: Dec. 3, 2013

(54) CUTTING DEVICE

(75) Inventor: Günther Weber, Groβ Nemerow (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 204 days.

(21) Appl. No.: 13/254,739

(22) PCT Filed: Feb. 11, 2010

(86) PCT No.: PCT/EP2010/000850
§ 371 (c)(1),
(2), (4) Date: Nov. 15, 2011

(87) PCT Pub. No.: WO2010/099856
PCT Pub. Date: Sep. 10, 2010

(65) Prior Publication Data

US 2012/0060663 A1 Mar. 15, 2012

(30) Foreign Application Priority Data

Mar. 3, 2009 (DE) ..... 10 2009 011 399

(51) Int. Cl.
*B26D 5/20* (2006.01)
*B26D 1/14* (2006.01)

(52) U.S. Cl.
USPC ..... 83/356; 83/493

(58) Field of Classification Search
USPC ..... 83/355, 356, 397, 397.1, 478, 493
See application file for complete search history.

(56) References Cited

U.S. PATENT DOCUMENTS

| | | | | |
|---|---|---|---|---|
| 2,479,182 | A | 8/1949 | Peters | |
| 3,353,430 | A * | 11/1967 | Brackmann et al. | 83/13 |
| 4,070,941 | A * | 1/1978 | Lorenz | 83/478 |
| 4,843,932 | A * | 7/1989 | Weber et al. | 83/490 |
| 5,074,179 | A * | 12/1991 | Omi | 83/478 |
| 6,591,723 | B1 | 7/2003 | Jung | |
| 2003/0037653 | A1 * | 2/2003 | Betti et al. | 83/174 |

FOREIGN PATENT DOCUMENTS

| | | |
|---|---|---|
| DE | 86 577 | 11/1970 |
| DE | 10 2005 062 501 | 6/2007 |
| EP | 0169 399 A2 | 1/1986 |
| EP | 0 202 777 A2 | 11/1986 |
| EP | 0 955 137 A2 | 4/1999 |
| EP | 0 974 432 A1 | 1/2000 |
| GB | 369 091 A | 3/1932 |

OTHER PUBLICATIONS

English translation of International Preliminary Report on Patentability dated Sep. 15, 2011 for PCT Patent Application PCT/EP2010/000850, 6 pages.
English language translation of German Search Report dated Feb. 9, 2010 for German Patent Application No. 10 2009 011 399.1, 5 pages.

* cited by examiner

*Primary Examiner* — Sean Michalski

(57) ABSTRACT

The invention relates to a cutting device for slicing food products, comprising a driven circular blade rotating about a blade axis revolving on a track about a center axis, and a cover element rotatable relative to the circular blade on the side of the circular blade facing away from a product to be sliced. The cover element is driven by an auxiliary drive, such that it rotates relative to the circular blade about the blade axis. The auxiliary drive is diverted from a drive of the circular blade.

14 Claims, 2 Drawing Sheets

CUTTING DEVICE

CROSS-REFERENCE TO RELATED APPLICATIONS

This is a national stage application of International Application No. PCT/EP2010/000850, filed Feb. 11 2011, entitled "Cutting Device," and claims priority to German Patent Application No. DE 10 2009 011 399.1, filed Mar. 3, 2009 both of which are fully incorporated herein by reference.

The present invention relates to a cutting apparatus for slicing food products, in particular to a high-performance slicer, having a drivable circular blade which rotates about a blade axis which revolves on an orbit about a center axis and having a cover element provided at the side of the circular blade remote from a product to be sliced and rotatable relative to the circular blade.

The cover element in such cutting apparatus serves the purpose of preventing a disturbing adhesion of cut-off product slices to the circular blade. The cover element can, for example, be formed as a shallow disk coaxial to the circular blade. Cut-off product slices thus come into contact with the disk and are scraped off thereat. Relatively soft food products can thus also be sliced at a high cutting rate in this manner. A cutting apparatus having a cover element is known from EP 0 169 399 B1, for example. The cover disk disclosed there is connected to a drive and can be rotated at an adjustable speed to provide a relative rotation between the circular blade and the cover disk. Such a relative rotation can be used for the direct influencing of the positioning of the product to be cut.

The provision of a separate drive for the cover element is, however, associated with a relatively high effort. In addition, it can be difficult to accommodate the drive in a suitable manner. The control of such a drive is also problematic since the correct speed difference between the cover disk and the circular blade must be able to be regulated at all times.

It is therefore an object of the invention to improve a cutting apparatus of the named kind with respect to the complexity, the space requirements and the reliability.

This object is satisfied by a cutting apparatus having the features of claim 1. In accordance with the invention, the cover element is driven by an additional drive such that it rotates relative to the circular blade about the blade axis, with the additional drive being drawn off a drive of the circular blade. No independent drive to be controlled separately is therefore provided for the cover element, but rather the drive of the circular blade anyway present is used to move the cover element in the desired manner. It was recognized in accordance with the invention that not only costs can be saved by an additional drive drawn off a drive of the circular blade, but also that an improvement of the reliability and a reduction of error proneness can generally be achieved. It is in particular precluded with a cutting apparatus in accordance with the invention that the cover element moves into an uncontrolled individual rotation due to a failure of the drive of the cover element or of its control and thus the placing of the cut-off product slices no longer takes place in the desired manner.

Further developments of the invention are set forth in the dependent claims, in the description and in the enclosed drawing.

The additional drive is preferably designed to prevent an individual rotation of the cover element about the blade axis relative to the product to be sliced during the revolutionary movement. It is thus avoided that a cut-off product slice is taken along by the cover element and hurled away in an uncontrolled manner.

The additional drive is preferably drawn off a drive of the circular blade which provides the revolutionary movement about the center axis. An individual rotation of the cover element during the total revolutionary movement can thereby be suppressed in a relatively simple manner.

In accordance with an embodiment, the additional drive is formed by a transmission arrangement which is in operative communication with the drive of the circular blade and with the cover element. It can be ensured by such a transmission arrangement that the rotational movement of the cover element is always in direct and immediate contiguity with the movement of the circular blade. A particularly reliable and failsafe influencing of the rotation of the cover element is possible by this direct mechanical coupling of the circular blade drive and the additional drive.

The transmission arrangement can include a belt drive, in particular a toothed belt drive, having a first belt pulley, a second belt pulley and a transmission belt. A belt drive is inexpensive and service-friendly. In addition, a smooth and relatively low-noise running is also ensured with a high revolutionary speed.

The belt drive can in particular be in engagement with a shaft rotatable relative to the circular blade and rotationally fixedly connected to the cover element. The second belt pulley can, for example, be directly fastened to the corresponding shaft. A rotationally fixed connection between the cover element and the belt pulley, on the one hand, and a rotatability between the cover element and the circular blade, on the other hand, is thus ensured.

In accordance with an embodiment, the circular blade is mounted on a hollow shaft element and the shaft of the cover element is led through the hollow shaft element. A decoupling of the rotational movements of the circular blade and the cover disk is possible in this manner despite a common axis of rotation.

The first belt pulley can be rotationally fixedly connected to the shaft of the cover element while the second belt pulley can be rotationally fixedly attached to a stationary element, in particular to a frame or to a housing of the cutting apparatus. The first belt pulley thus rolls off at the toothed belt during the revolutionary movement of the circular blade head, said toothed belt in turn being in engagement with the second belt pulley fixed at the frame. It can be achieved in this manner that the cover element is always further rotated during the revolutionary movement such that as a result no individual rotation takes place relative to the product to be sliced.

The cover element can include a pulley which is coaxial to the circular blade and which extends radially up to the region of the cutting edge of the circular blade. The cut-off product slices thus come largely fully into contact with the cover element, whereby a reliable scraping off is made possible without adhesion problems at the circular blade.

The cover element is preferably provided with elevated portions at the side remote from the circular blade. Such elevated portions can further improve the placement of product slices since an unwanted adhesion to the stationary cover element is prevented.

The invention will be described in the following by way of example with reference to the drawings.

Figure 1:
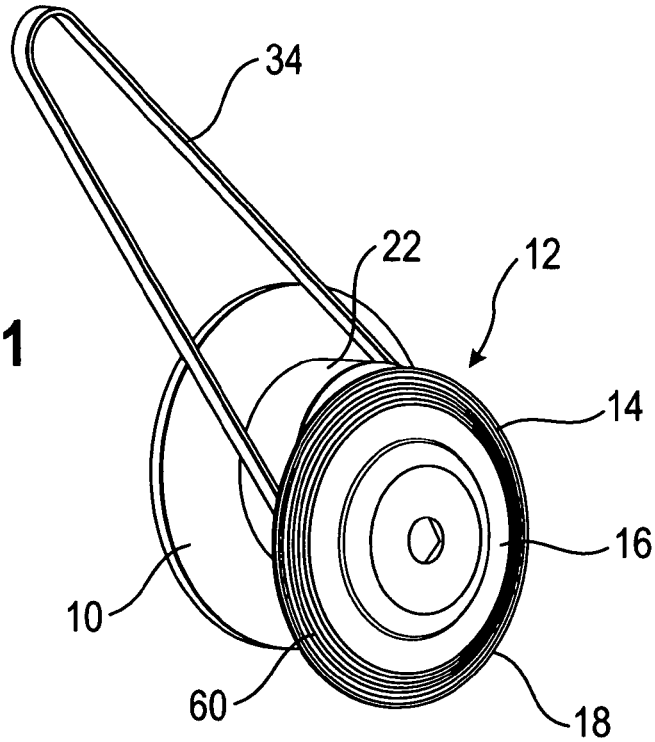
FIG. 1 is a schematic part representation of a cutting apparatus in accordance with the invention in a perspective view.

FIG. 1 shows a part of a high-performance slicer whose base frame is symbolized by the component 10. A circular blade head 12 having a disk-shaped circular blade 14 and a cover element 16 associated with the circular blade 14 is supported at the base frame 10. The cover element 16 is formed as a cover disk arched in hood-like or plate-like form and closely contacting the circular blade 14 and extends radially up to and into the region of the cutting edge 18 of the circular blade 14. A side of the circular blade is thus covered almost over its full area by the cover disk 16.

Figure 2:
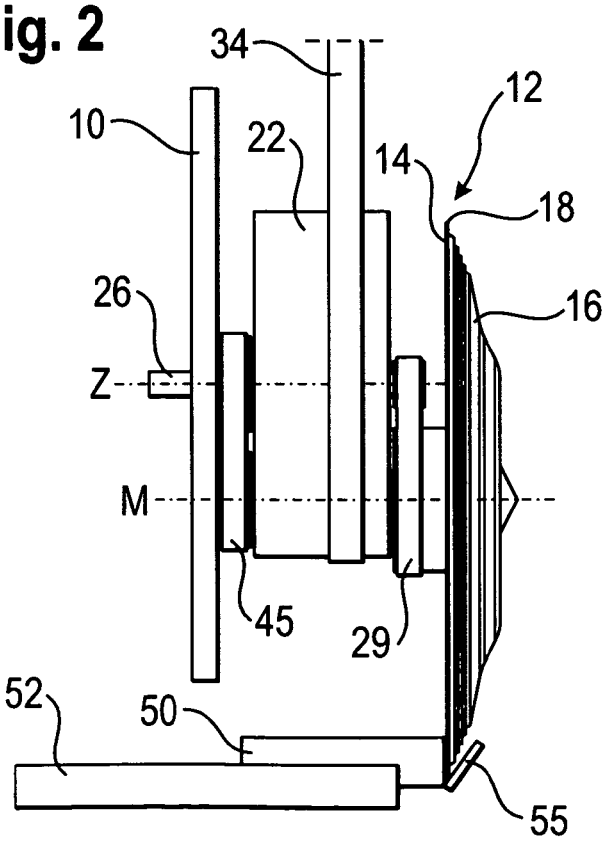
FIG. 2 is a side view of the cutting apparatus in accordance with FIG. 1.
Figure 3:
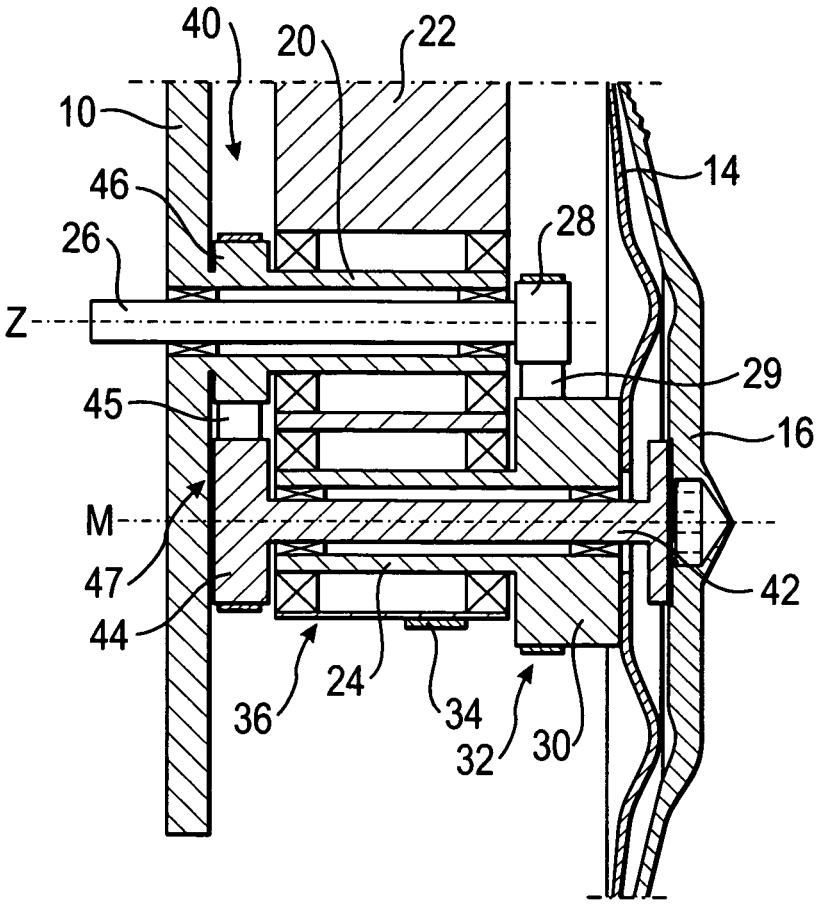
FIG. 3 is a part sectional view of the representation in accordance with FIG. 2.

The circular blade 14 is driven revolving in a planetary motion to slice food products, as will be explained in more detail in the following with reference to FIGS. 2 and 3.

A central hollow shaft element 20 which defines a center axis Z is attached to the base frame 10. An eccentric disk 22 is rotatably supported on the central hollow shaft element 20. An eccentric hollow shaft element 24 is supported laterally offset from the center axis Z in the eccentric disk 22 and defines a blade axis M. The circular blade 14 is fastened to the eccentric hollow shaft element 24. A drive shaft element 26 which is drivable by a motor, not shown, is led through the central hollow shaft 20 and carries a first drive belt pulley 28. The first drive belt pulley 28 is in engagement via a toothed belt 29 with a second drive belt pulley 30 which is rotationally fixedly attached to the eccentric hollow shaft element 24 or is made in one piece therewith. The arrangement of drive shaft element 26, first and second drive belt pulleys 28, 30 and toothed belt 29 thus forms a first drive 32 which provides a rotational movement of the circular blade 14 about the blade axis M.

The eccentric disk 22 is in engagement with an eccentric toothed bet 34 which is drivable via an arrangement, not shown, of motor and belt pulley. The eccentric disk 22 can thus be rotatingly driven about the center axis Z. Due to the eccentric support of the circular blade 14, a rotation of the eccentric disk 22 effects a revolutionary movement of the circular blade 14 on a circular orbit about the center axis Z. The arrangement of eccentric toothed belt 34 and eccentric disk 22 is thus associated with a second drive 36 which provides a revolutionary movement of the circular blade 14 about the center axis Z. Since the revolutionary movement and the rotational movement are decoupled from one another and are driven separately, the respective speeds can be set as desired.

To counter an individual rotation of the cover disk 16 about the blade axis M during the operation of the cutting apparatus, an additional drive 40 is provided which is drawn off the second drive 36 and includes a guide belt drive 47 for the controlled guidance of the cover disk 16. The cover disk 16 is for this purpose rotationally fixedly attached to a carrier shaft element 42 which is led through the eccentric hollow shaft element 24 and is rotationally fixedly connected at an end disposed opposite the cover disk 16 to a first guide belt pulley 44. The first guide belt pulley 44 is in engagement via a guide toothed belt 45 with a second guide belt pulley 46 which is rotationally fixedly attached to the central hollow shaft element 20 or is made in one piece therewith. The additional drive 40 is therefore formed by the arrangement of carrier shaft element 42, first guide belt pulley 44, guide toothed belts 45 and second guide belt pulley 46 and is integrated in the circular blade head 12.

During the planetary revolution of the circular blade 14, the first guide belt pulley 44 rolls off on the guide toothed belt 45 which in turn runs over the second guide belt pulley 46 fixed to the frame. The cover disk 16 thus undergoes a compulsory rotatory drive which results from the revolutionary movement of the carrier shaft element 42. As can be seen from FIG. 3, the diameters of the first guide belt pulley 44 and of the second guide belt pulley 46 are of equal size so that a transmission ratio of 1 results for the guide belt drive 47. This has the consequence that the cover disk 16 does not carry out any individual rotation about the blade axis M during the revolutionary movement relative to a product bar 40 to be sliced (FIG. 2). If the respective application should require a specific rotation of the cover disk 16 about itself, a different transmission ratio can, however, also be selected for the guide belt drive 47.

During the operation of the cutting apparatus, the circular blade 14 approaches the product bar 50 to be sliced on its revolutionary orbit , said product bar being located on a product feed 52 and being advanced automatically by means of a controlled drive (not shown). In the further course of the planetary revolutionary movement, the cutting edge 18 of the circular blade 14 cuts off a product slice 55 from the product bar 50. The cover disk 16 provides that the cut-off product slice 55 does not adhere to the rotating circular blade 14, but is rather scraped off at the surface of the cover disk 16. The convex arch of the cover disk 16 supports the controlled scraping off of the product slice 55. Peripheral elevated portions 60 at the surface of the cover disk 16 are provided for the further improvement of the scraping off process. An exact and reproducible placement behavior is ensured due to the individual rotation of the cover disk 16 being reliably prevented by the additional drive 40. The cut-off product slice 55 falls in an exact position from the cover disk 16 and can be further processed in any desired manner, in particular supplied to an automatic placement line, transport line and/or packaging line.

Different other transmission arrangements such as a toothed wheel transmission could be used instead of the guide belt drive 47.

Since the additional drive 40 for the cover disk 16 is drawn directly off the drive 36 of the circular blade 14, a simple, inexpensive and extremely reliable type of speed influencing results for the cover disk 16. A separate motor including the associated control is not necessary.

REFERENCE NUMERAL LIST

10 base frame
12 circular clade head
14 circular blade
16 cover disk
18 cutting edge
20 central hollow shaft element
22 eccentric disk
24 eccentric hollow shaft element
26 drive shaft element
28 first drive belt pulley
29 toothed belt
30 second drive belt pulley
32 first drive
34 eccentric toothed belt
36 second drive
40 additional drive
42 carrier shaft element
44 first guide belt pulley
45 guide toothed belt
46 second guide belt pulley
47 guide belt drive
50 product bar
52 product feed
55 product slice
60 elevated portion
Z center axis
M blade axis

The invention claimed is:

1. A cutting apparatus for slicing food products, comprising a drivable circular blade (14) which rotates about a blade axis (M) which revolves on an orbit about a center axis (Z); and a cover element (16) provided at a side of the circular blade (14) remote from a product (50) to be sliced and rotatable relative to the circular blade (14), wherein the cover element (16) is driven by an additional drive (40) such that it rotates relative to the circular blade (14) about the blade axis (M), wherein the additional drive (40) is drawn off a drive (32, 36) of the circular blade (14).

2. An apparatus in accordance with claim 1, wherein the additional drive (40) is designed to prevent an individual rotation of the cover element (16) relative to the product (50) to be sliced about the blade axis (M) during the orbital movement.

3. An apparatus in accordance with claim 1, wherein the additional drive (40) is drawn off a drive (36) of the circular blade (14) which provides the orbital movement about the center axis (Z).

4. An apparatus in accordance with claim 1, wherein the additional drive (40) is formed by a transmission arrangement which is in effective communication with the drive (32, 36) of the circular blade (14) and with the cover element (16).

5. An apparatus in accordance with claim 4, wherein the transmission arrangement includes a belt drive (47) having a first belt pulley (44), a second belt pulley (46) and a transmission belt (45).

6. An apparatus in accordance with claim 5, wherein the belt drive (47) is a toothed belt drive.

7. An apparatus in accordance with claim 5, wherein the belt drive (47) is in engagement with a shaft (42) rotatable relative to the circular blade (14) and rotationally fixedly connected to the cover element (16).

8. An apparatus in accordance with claim 7, wherein the circular blade (14) is mounted on a hollow shaft element (24) and the shaft (42) of the cover element (16) is led through the hollow shaft element (24).

9. An apparatus in accordance with claim 7, wherein the first belt pulley (44) is rotationally fixedly connected to the shaft (42) of the cover element (16).

10. An apparatus in accordance with claim 9, wherein the stationary element is a frame or a housing of the cutting apparatus.

11. An apparatus in accordance with claim 5, wherein the second belt pulley (46) is rotationally fixedly attached to a stationary element (10).

12. An apparatus in accordance with claim 1, wherein the cover element (16) includes a pulley which is coaxial to the circular blade (14) and which extends radially up to the region of the blade edge (18) of the circular blade (14).

13. An apparatus in accordance with claim 1, wherein the cover element (16) is provided with elevated portions (60) at the side remote from the circular blade (14).

14. An apparatus in accordance with claim 1, wherein the apparatus is a high performance slicer.

* * * * *

UNITED STATES PATENT AND TRADEMARK OFFICE

CERTIFICATE OF CORRECTION

PATENT NO. : 8,596,175 B2
APPLICATION NO. : 13/254739
DATED : December 3, 2013
INVENTOR(S) : Günther Weber It is certified that error appears in the above-identified patent and that said Letters Patent is hereby corrected as shown below:

In the Specifications:

| | |
|---|---|
| Column 3, Line 20 | After “shaft”, insert --element-- |
| Column 3, Line 30 | Delete “bet” and insert --belt-- |
| Column 4, Line 4 | Delete “40” and insert --50-- |
| Column 4, Line 42 | Delete “clade” and insert --blade-- |

Signed and Sealed this
Twenty-seventh Day of May, 2014

Michelle K. Lee

Michelle K. Lee
*Deputy Director of the United States Patent and Trademark Office*